US005426442A

United States Patent [19]

Haas

[11] Patent Number: 5,426,442

[45] Date of Patent: Jun. 20, 1995

[54] CORRUGATED FEED HORN ARRAY STRUCTURE

[75] Inventor: Robert W. Haas, Claremont, Calif.

[73] Assignee: Aerojet-General Corporation, Rancho Cordova, Calif.

[21] Appl. No.: 24,079

[22] Filed: Mar. 1, 1993

[51] Int. Cl.[6] ..... H01Q 13/00

[52] U.S. Cl. ..... 343/778; 343/772; 343/776; 343/786

[58] Field of Search ..... 343/778, 772, 776, 786, 343/782, 774, 784; H01Q 13/00

[56] References Cited

U.S. PATENT DOCUMENTS

| | | | |
|---|---|---|---|
| 3,914,861 | 10/1975 | Phillips | 343/786 |
| 3,943,521 | 3/1976 | Phillips | 343/786 |
| 4,408,208 | 10/1983 | Dumas | 343/786 |
| 4,527,165 | 7/1985 | De Ronde | 343/778 |
| 4,862,186 | 8/1989 | Strider | 343/776 |
| 5,128,689 | 7/1992 | Wong et al. | 343/853 |

FOREIGN PATENT DOCUMENTS

| | | | |
|---|---|---|---|
| 8909501 | 10/1989 | WIPO | H01Q 21/06 |

*Primary Examiner*—Donald Hajec
*Assistant Examiner*—Hoan Ganh
*Attorney, Agent, or Firm*—Leonard Tachner; Adam Tachner

[57] ABSTRACT

A unitary array of efficient directional corrugated feed horns, each having a desired corrugated horn cross-section within close tolerances, as well as accurate positioning and orientation relative to each other. The unitary array structure is comprised of a plurality of thin platelets which are laminated together in a selected sequence. The unitary array design provides a mechanical structure to support millimeter and sub-millimeter wavelength electronic devices for reception or transmission of electromagnetic energy and cooling fluid circulation channels within the array to remove unwanted heat generated by the attached electronic devices. The design of the present invention affords a relatively lightweight structure through removal of unneeded materials by forming cavities within the structure while leaving sufficient material for the bonding of the platelet assembly.

14 Claims, 4 Drawing Sheets

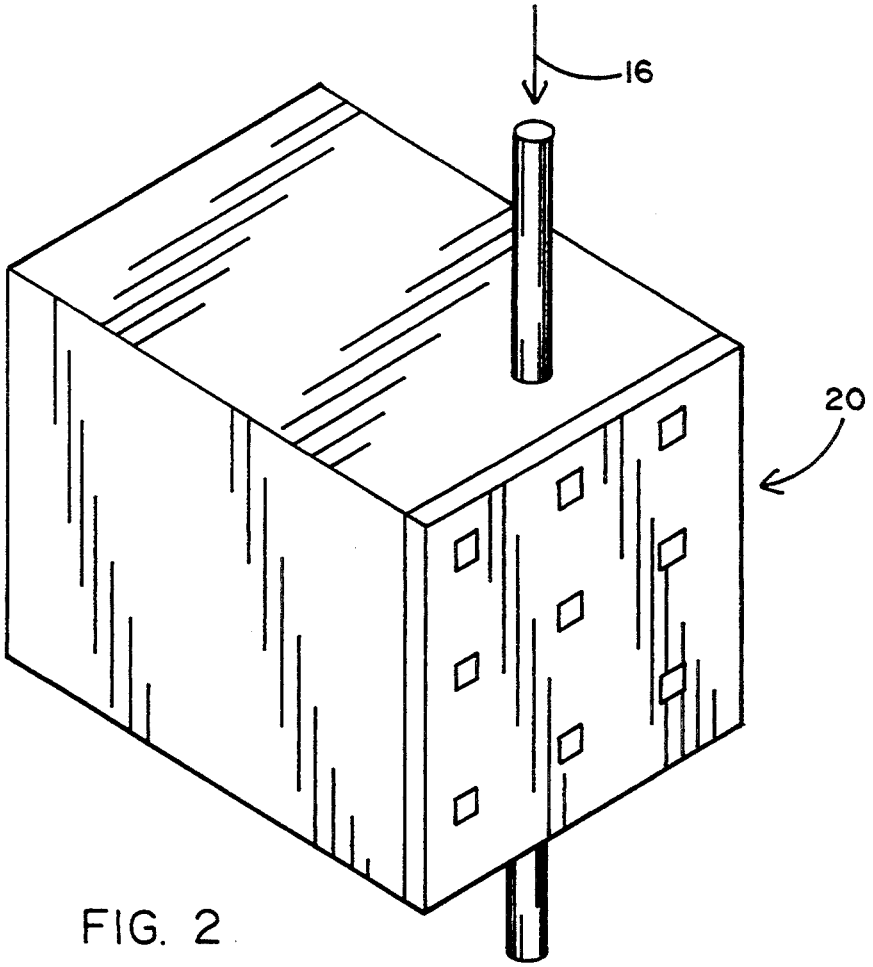
FIG. 2
FIG. 4A
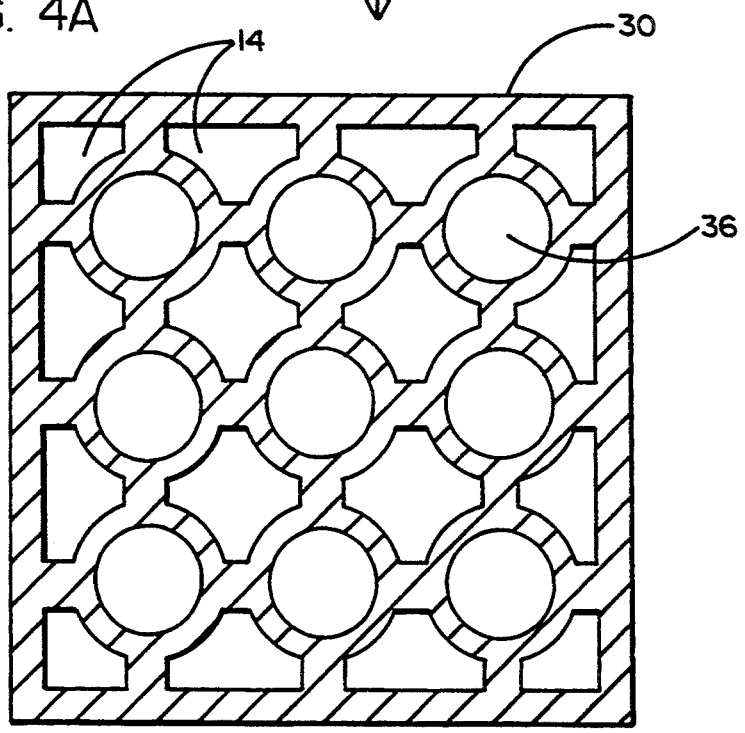

CORRUGATED FEED HORN ARRAY STRUCTURE

FIELD OF THE INVENTION

The present invention relates generally to antennas, and more specifically to corrugated feed horn antenna arrays. The invention further relates to a relatively inexpensive technique of manufacturing such antenna arrays in large numbers within close tolerances, while resulting in a lightweight cooled, unitary structure formed from a plurality of thin platelets.

PRIOR ART

Multiple beam antenna systems are designed to receive or transmit energy in many separate simultaneous directions. Thus, arrays including many feeds provide an effective apparatus to receive or transmit simultaneous signals. For a transmission or receiving system incorporating numerous feeds to be practical, the feeds must be inexpensive to manufacture. Also, these feeds must satisfy exacting performance requirements in regard to their radiation patterns, efficiency, and loss characteristics.

Corrugated feed horns provide excellent performance in feeding millimeter wave and sub-millimeter wave signals to receivers or transmission devices. A corrugated feed horn with ridges much narrower than the grooves therebetween, provides optimum performance characteristics. The ridges and grooves alternate in an inner conical configuration, thus creating the corrugated horn shape. The corrugated horn shape provides low loss and symmetrical radiation patterns with low sidelobes and low cross-polarization.

The corrugated horn antenna array can be used for the reception or radiation of electromagnetic energy such as required for millimeter wave or sub-millimeter wave imaging, radar or communications systems. In practice, a corrugated feed horn antenna array would normally be used in conjunction with a receiver or transmitter array and a reflector or lens. The electronic devices create large amounts of heat which must be dissipated for reliable long-term use.

Prior to this invention, arrays of corrugated feed horns would have to be assembled from individually manufactured horns. Such arrays would be expensive, heavy and would fail to provide mechanical support for, or provide a method for cooling of, electronic devices. While other techniques of fabricating low cost arrays of millimeter wave and sub-millimeter wave antennas exist, the resulting antennas are not as efficient as the preferred corrugated horn, nor are their radiation patterns as desirable.

All prior art known to the applicant is characterized by the aforementioned shortfalls, namely expensive assembly of heavy individual units which excludes cooling and mechanical support means, or low antenna efficiency and less than optimal radiation patterns. Consequently, there is an inherent disadvantage in the use of prior art corrugated horns and antenna arrays for millimeter wave and sub-millimeter wave applications.

There is, therefore, an existing need for an antenna array and a method of manufacture for such an array which is light, inexpensive, incorporates the corrugated horn design and allows for cooling and structural support of attached electronic devices. The applicant knows of no prior art which satisfies all of the aforementioned problems. More specifically, the following prior art is deemed to be the most relevant known to the applicant.

U.S. Pat. No. 4,408,208 is directed to a corrugated feed horn for millimeter wave frequencies comprising a laminated structure of thin ridges and relatively deep grooves. The inner diameter of the horn decreases in the laminated plates within the horn as the plates near the base of the horn, thus forming a conical profile. The laminated plates are brazed to form the final feed horn apparatus. Brazing the plates together requires a large surface area on each plate which would preclude production of a lightweight horn. Also, there is no discussion of cooling the assembled structure, nor of using the disclosed method to create an array of corrugated feed horns.

U.S. Pat. No. 4,783,665 is directed to a hybrid mode horn antenna with a cylindrical and expanded horn-shaped waveguide with its wall covered with alternate grids of conductive and dielectric material so that it functions as a corrugated horn, but is easier to produce than a single corrugated horn as described in U.S. Pat. No. 4,408,208 above. The horns are manufactured by turning or casting a dielectric with surfaces which are treated by a metalization process. While this method of manufacture avoids expensive mechanical lathe operations and allows for manufacture of lightweight antenna array, the patent neither discusses the possibility of supporting external devices nor discloses any method for cooling such devices.

U.S. Pat. No. 4,527,165 is directed to a miniature horn antenna array meant only for circular polarization of high frequency signals comprising a succession of layers. The five layers comprise a first insulating layer with horns formed with flared openings and metalized walls; a thin dielectric film supporting conductive transmission lines; a second array of waveguides also having metalized walls; a second dielectric film supporting conductive lines of a second supply network; and, a third insulating layer including a third array of waveguides having metalized walls. While the design is well-suited for circularly polarized signals, simultaneous signals cannot be received or transmitted by this device.

U.S. Pat. No. 5,105,200 is directed to a superconducting phased antenna array which provides an improvement in gain at frequencies in the range of 40–100 Ghz and beyond. The antenna has a dielectric substrate with a planar layer of superconducting material forming an antenna element and feed network forming a microstrip antenna and strip line connector. The complete apparatus includes a means for cooling with a cryogenic refrigeration unit and heat transfer means. While this design is well-suited for use as a phased antenna array, multi-directional simultaneous signals cannot be received or transmitted by this device.

U.S. Pat. No. 4,888,597 is directed to a two-dimensional integrated circuit antenna structure for transmitting or receiving millimeter wave and/or sub-millimeter wave radiation. The structure is a horn disposed on a substrate with the antenna suspended relative to the horn. The antenna structure, an array of antennas suspended on a membrane, has a plurality of horns formed on a front substrate and a back substrate. The horns are coated with gold or other suitable reflective material. Though this design incorporates the multi-surface lamination technique for creating the receiving or transmitting architecture, it relies upon anisotropic etching of silicon and results in horns which are not corrugated, have lower efficiency then a corrugated horn, and whose beamwidths can not be tailored to given applications. Moreover, it appears that the two-dimensional nature of the structure and the method used for creating this structure would not permit cooling channels to be incorporated in the structure.

U.S. Pat. No. 4,862,186 is directed to a microwave antenna array waveguide assembly for use with millimeter wave frequencies and is configured by combining plates which are formed into a plurality of equal length members protruding from and perpendicularly disposed to a structure member. Metal plates are brought together and held mechanically by bolts without welding or brazing to form a waveguide. Any number of plates may be used to form different geometrical sizes and shapes of antennas. This design allows for high precision by avoiding the brazing process which can alter the shape of metal parts. The simple bolted fastening method also keeps the cost of the device low. However, this design creates only flat-walled waveguide arrays, not the often preferred corrugated feed horn arrays.

SUMMARY OF THE INVENTION

The present invention incorporates the preferred horn shape in a platelet assembly manufacturing technique which allows a large array of corrugated horns to be fabricated in one, lightweight structure with provision for attaching electronic components and with cooling channels incorporated into the assembly. The assembled platelet horn array is composed of corrugated horns which can be used as feeds in a multiple beam antenna for millimeter wave or sub-millimeter wave remote sensing, imaging, or communication applications.

The platelet horn array is fabricated using platelet technology. Platelets are thin sheets of metal containing patterns of holes. These sheets are sandwiched together in a stack of many layers, and then diffusion bonded together to make a single construction, having within it holes, channels, or cavities of selected shapes. The hole patterns are designed to incorporate the corrugated horn design, cooling channels, and to remove any unnecessary volume to decrease the weight of the assembly. These hole patterns are defined and etched in the individual platelets using standard photo lithographic or laser machining techniques. Thus, once a design is completed and the photo lithographic masks or machine programs are created, many platelets can be reproduced accurately and economically.

In one embodiment, the present invention comprises a platelet horn array made up of many platelets sandwiched together using a diffusion bonding method of adhesion. The horns form a conical shape having internal corrugated surfaces consisting of alternate ridges and grooves. In one embodiment, nine corrugated horns are arranged in arbitrary geometries. The weight of the complete array is reduced by removing unnecessary material between the horns within each platelet before assembly. Individual millimeter wave or sub-millimeter wave receivers or an array of receivers may be electrically, thermally, and mechanically mated with the assembled platelet corrugated horn array. The assembled platelet corrugated horn array supplies the support structure for the attached electronic device array. As attached devices generate unwanted heat, cooling channels incorporated into the platelets before assembly allow cooling fluid to flow through passages internal to the platelet array.

OBJECTS OF THE INVENTION

It is therefore a principal object of the present invention to provide an array of efficient, directional corrugated feed horns in a unitary structure each such horn having a desired corrugated horn cross-section within close tolerances, as well as accurate positioning and orientation relative to the other horns.

It is an additional object of the present invention to provide a mechanical structure to support millimeter wave and sub-millimeter wave electronic devices for reception and transmission of electromagnetic energy.

It is a further object of the present invention to incorporate cooling fluid circulation channels into an array of corrugated feed horns to remove unwanted heat generated by attached electronic devices.

Still another object of the present invention is to create a relatively lightweight array of corrugated feed horns by providing for removal of unneeded material to reduce the weight of the finished structure while leaving sufficient material for the bonding of a platelet assembly.

It is still another object of the invention to provide a unitary structure of a plurality of directional high frequency corrugated antennas, the structure being formed by a plurality of platelets bonded together to align apertures of selected size, shape and location.

BRIEF DESCRIPTION OF THE DRAWINGS

The aforementioned objects and advantages of the present invention as well as additional objects and advantages thereof will be more clearly understood hereinafter as a result of a detailed description of a preferred embodiment of the invention when taken in conjunction with the following drawings in which:

FIG. 2 is an isometric view of an electronic device array mated with the preferred embodiment of the invention;

FIGS. 4A, 4B, 4C and 4D, illustrates various individual platelets used in forming the preferred embodiment of the invention.

DETAILED DESCRIPTION OF A PREFERRED EMBODIMENT

Figure 1:
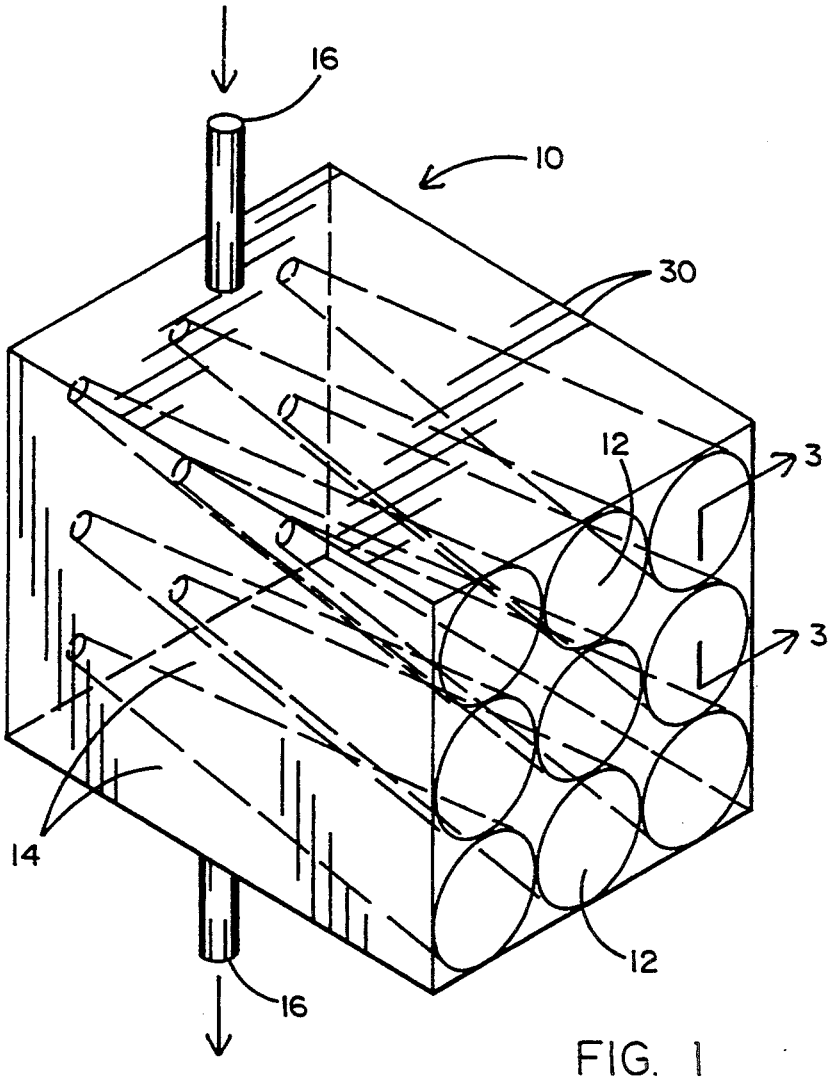
FIG. 1 is an isometric view of a preferred embodiment of the invention.

Referring to the accompanying figures, it will be seen that a structure 10 composed of sandwiched platelets 30, in accordance with a preferred embodiment of the present invention, provides an array of corrugated horns 12 between which unnecessary materials have been removed to form cavities 14 before assembly. Cooling channels 15 (see FIGS. 4 and 5) are incorporated into the platelet design and processing before assembly. The cooling channels are supplied with fluid through inlet and outlet 16 which attach the cooling system to a source of circulating cooling fluid.

Diffusion bonding is the preferred method of coupling the platelets in the embodiment of FIG. 1. Diffusion bonding can be used to bond parts with small surface areas in common, thus proving appropriate for use in coupling platelets where a large portion of the surface area has been removed to accommodate cooling channels, horn array configurations and to lighten overall weight, before bonding. Diffusion bonding is preferable to other coupling methods, such as brazing, which require surface-distorting intense heat and large shared surface areas. Such alternate bonding methods are not conducive to producing horn arrays of close tolerance in large numbers. Diffusion bonding of the platelets in the present invention allows for close tolerances to be maintained in a lightweight, economical assembled structure.

FIG. 2 illustrates an attached receiver array 20, mated with a preferred embodiment of the platelet corrugated horn antenna array. Such electronic device arrays may be electrically, thermally and mechanically mated with the array horns. The resulting transfer of thermal energy to the horn array is offset by cooling channels incorporated into the individual platelet design. These cooling channels are fed cooling fluid through the fluid inlet and outlet 16.

Figure 3:
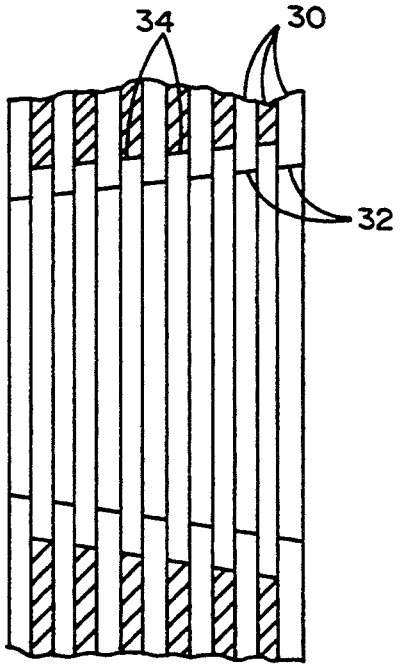
FIG. 3 is a cross-sectional view of ridges, grooves and spaces within a preferred embodiment of the invention.

FIG. 3 illustrates a cross-section of sandwiched platelets 30. Said platelets form either ridges 32 or grooves 34 which, when sandwiched together, create a corrugated horn-shaped surface. Also incorporated into each platelet before assembly are holes used to form cooling channels 15. Such cooling channels dissipate heat collected from electronic devices or device arrays mated to the horn array which are used in transmission or reception of electromagnetic energy. A further feature of each platelet included in FIG. 3 is the existence of cavities 14 formed by the removal of excess materials thus creating a lightweight final assembly.

Figure 4C:
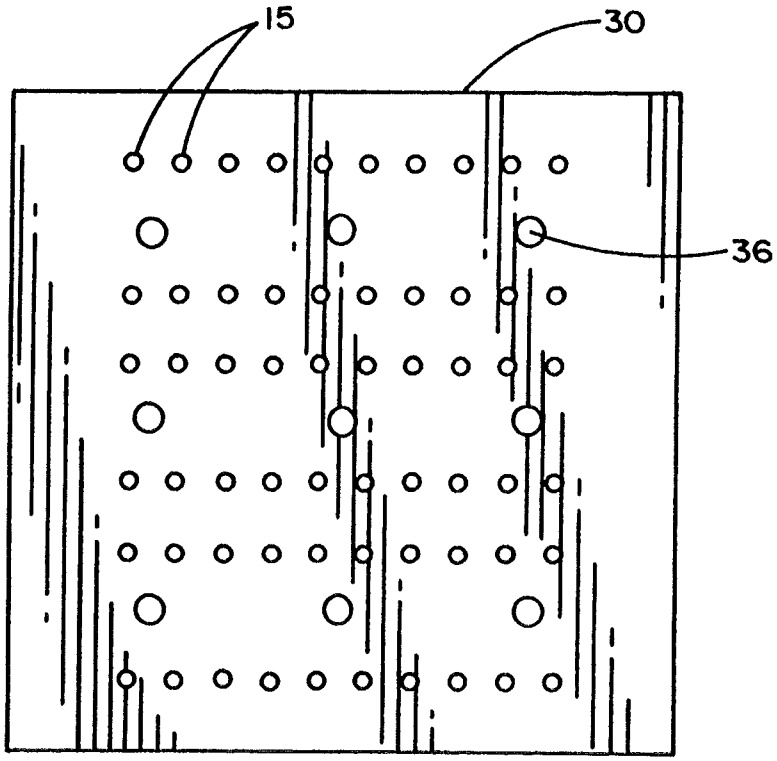
Figure 4B:
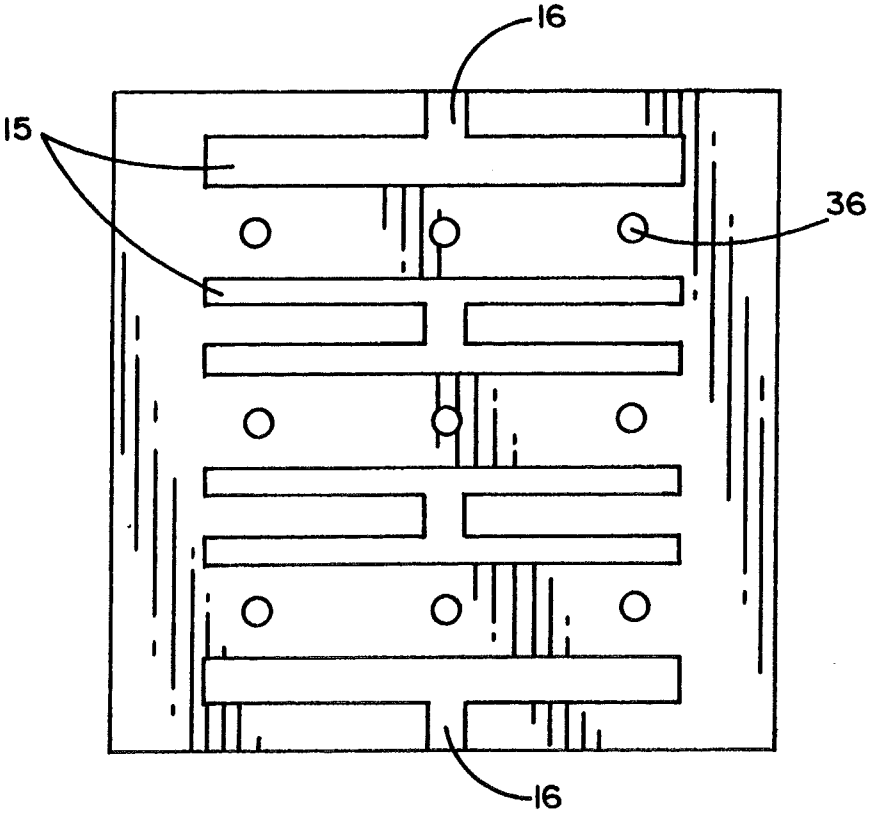
Figure 4D:
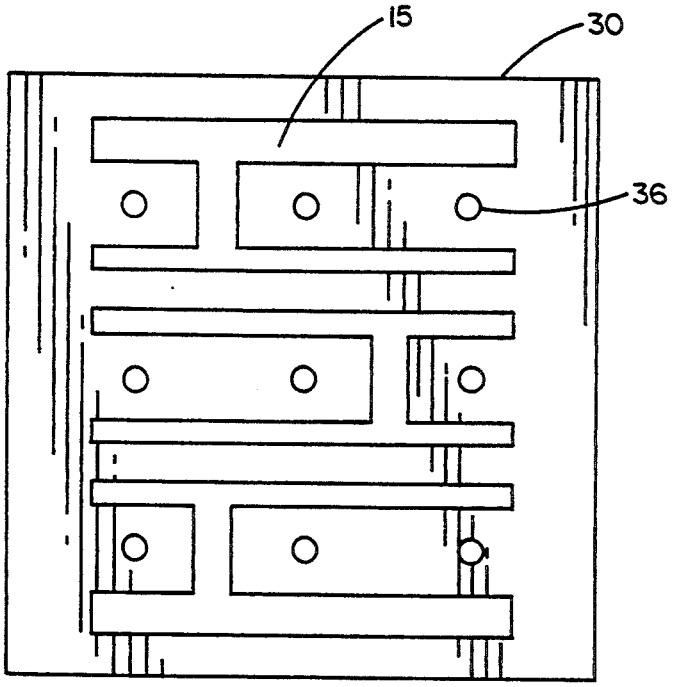

Various individual platelets 30 are illustrated in FIG. 4A, B, C and D. FIG. 4A illustrates a platelet 30 in which there are weight reduction cavities 14 and holes 36 which form parts of the horns 12. FIGS. 4B, C and D illustrate platelets 30 in which there are cooling channels 15 and horn holes 36 as well as portions of inlet and outlet 16.

Figure 5:
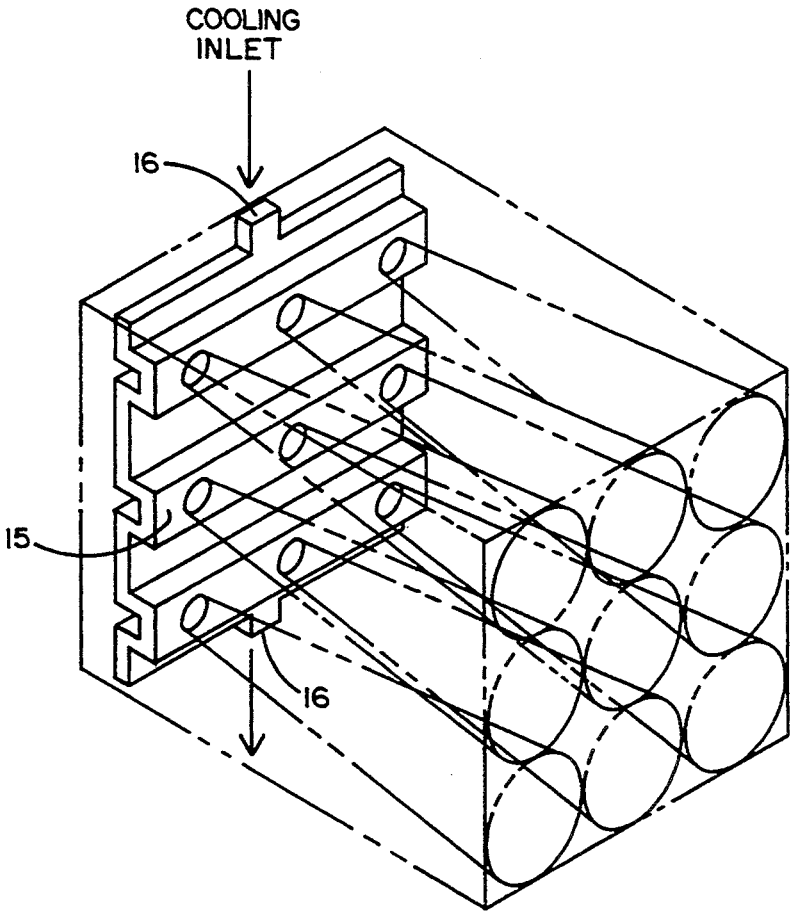
FIG. 5 is an additional view of the invention similar to FIG. 1, but more specifically illustrating the cooling channels thereof.

FIG. 5 illustrates the assembled platelets 30 in a view which better reveals the fully configured cooling channels 15.

It will be understood that what has been disclosed herein comprises a novel laminated platelet structure providing a corrugated horn array of efficient, directional corrugated feed horns each having a desired horn cross-section fabricated within close tolerances, as well as accurate positioning and orientation relative to the other such horns. The platelet corrugated horn array provides a lightweight yet strong mechanical structure to support millimeter wave and sub-millimeter wave electronic devices for reception and transmission of electromagnetic energy. Cooling fluid circulation channels are provided to remove excess heat generated by the attached electronic devices. Also disclosed herein is a method for assembling platelet corrugated horn arrays through diffusion bonding, requiring very little common surface area between platelets and allowing for close tolerances to be met in the finished structure.

Those having skill in the art to which the present invention pertains will now, as a result of the applicant's teaching herein, perceive various modifications and additions which may be made to the invention. By way of example, the precise shapes, relative dimensions, and number of horns included in an assembled array may be altered while still preserving the cooling, weight, and adaptability advantages of the platelet formed horn array assembly. Accordingly, all such modifications and additions are deemed to be within the scope of the invention which is to be limited only by the claims appended hereto.

I claim:

1. An antenna array of independent corrugated horns for use in reception or transmission of electromagnetic energy the array comprising:

a plurality of electrically conductive platelets containing pre-selected patterns of holes of various shapes and sizes;

said platelets sandwiched together and forming a unitary structure having an array of corrugated antenna surfaces, each such surface being formed by the alignment of said holes along a common pre-selected axis;

wherein a plurality of said holes are aligned to form at least one common cooling channel throughout said unitary structure; said antenna array further comprising:

at least one fluid inlet and at least one fluid outlet connected to said cooling channel for delivering and recovering cooling fluid, respectively, for cooling said unitary structure.

2. The antenna array recited in claim 1, wherein a plurality of said holes are aligned to form at least one cavity within said unitary structure for decreasing the weight of said unitary structure.

3. The antenna array recited in claim 1, wherein said unitary structure comprises at least one surface suitable for structurally supporting electronic devices operatively connected to said antenna surfaces for processing said electromagnetic energy.

4. The antenna array recited in claim 1, wherein each said platelet is fabricated using a photolithographic process.

5. The antenna array recited in claim 1, wherein each said platelet is formed by laser machining.

6. The antenna array recited in claim 1, wherein said platelets are permanently joined by diffusion bonding.

7. A laminated antenna structure comprising:

a plurality of independent corrugated antenna elements in a common electrically conductive integrated structure;

said structure being formed by a plurality of thin metal plates, each such plate having a plurality of apertures of pre-selected size, shape and position;

said plates being laminated together to form said integrated structure, at least some of said apertures being aligned in pre-selected directions to form said antenna elements;

wherein a plurality of said apertures are aligned to form at least one common cooling channel throughout said integrated structure; said antenna structure further comprising:

at least one fluid inlet and at least one fluid outlet connected to said cooling channel for delivering and recovering cooling fluid, respectively, for cooling said integrated structure.

8. The antenna structure recited in claim 7, wherein a plurality of said apertures are aligned to form at least one hollow within said integrated structure for decreasing the weight of said integrated structure.

9. The antenna structure recited in claim 7, wherein said integrated structure comprises at least one surface adapted for receiving a plurality of electronic devices electrically and mechanically mated to said antenna elements for processing electromagnetic energy.

10. The antenna structure recited in claim 7, wherein each said plate is fabricated using a photolithographic process.

11. The antenna structure recited in claim 7, wherein each said plate is formed by laser machining.

12. The antenna structure recited in claim 7, wherein said plates are permanently secured together by diffusion bonding.

13. An antenna array of independent corrugated horns for use with electromagnetic energy, comprising:

a plurality of electrically conductive platelets containing pre-selected patterns of holes;

said platelets being sandwiched together and forming a unitary structure of corrugated antenna surfaces, each such surface being formed by the alignment of said holes along a common pre-selected axis;

some of said holes being aligned to form at least one common cooling channel throughout said unitary structure;

at least one fluid inlet and at least one fluid outlet connected to said cooling channel for delivering and recovering cooling fluid, respectively, for cooling said unitary structure;

others of said holes being aligned to form at least one cavity within said unitary structure for decreasing the weight of said unitary structure;

at least one surface of said unitary structure being suitable for structurally supporting electronic devices operatively connected to said antenna surfaces for processing said electromagnetic energy.

14. A laminated antenna structure comprising:

a plurality of independent corrugated antenna elements in a common integrated structure;

said structure being formed by a plurality of thin metallic plates, each such plate having a plurality of apertures of preselected size, shape and position;

said plates being laminated together to form said integrated structure, at least some of said apertures being aligned in pre-selected directions to form said antenna elements;

some of said apertures being aligned to form at least one common cooling channel through said integrated structure;

at least one fluid inlet and at least one fluid outlet connected to said cooling channel for delivering and recovering cooling fluid, respectively, for cooling said integrated structure;

some of said apertures being aligned to form at least one hollow within said integrated structure for decreasing the weight of said integrated structure;

at least one surface of said structure being adapted for receiving a plurality of electronic devices electrically and mechanically mated to said antenna elements for processing electromagnetic energy.

* * * * *